US006882818B2

(12) United States Patent
Kurosu

(10) Patent No.: US 6,882,818 B2
(45) Date of Patent: Apr. 19, 2005

(54) IMAGE FORMING APPARATUS HAVING A DEVELOPMENT APPARATUS FORMING A MAGNETIC BRUSH SEPARATED FROM A LATENT IMAGE CARRIER OUTSIDE A DEVELOPMENT AREA

(75) Inventor: Hisao Kurosu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/098,862

(22) Filed: Mar. 15, 2002

(65) Prior Publication Data

US 2002/0191989 A1 Dec. 19, 2002

(30) Foreign Application Priority Data

Mar. 21, 2001 (JP) ..... 2001-079798
Mar. 23, 2001 (JP) ..... 2001-085621

(51) Int. Cl.[7] ..... G03G 15/09
(52) U.S. Cl. ..... 399/267; 399/274
(58) Field of Search ..... 399/267, 274, 399/284, 272, 282

(56) References Cited

U.S. PATENT DOCUMENTS

| | | | | |
|---|---|---|---|---|
| 3,967,892 A | * | 7/1976 | Whited | |
| 4,653,896 A | * | 3/1987 | Horie et al. | 399/267 |
| 4,860,417 A | * | 8/1989 | Tajima et al. | |
| 5,428,428 A | * | 6/1995 | Haneda | |
| 5,752,139 A | * | 5/1998 | Sumikawa et al. | |
| 5,845,183 A | * | 12/1998 | Sugiyama et al. | 399/272 |
| 6,075,964 A | * | 6/2000 | Ochiai et al. | |
| 6,088,563 A | * | 7/2000 | Shimizu | |
| 6,160,979 A | * | 12/2000 | Shoji | 399/267 |
| 6,198,895 B1 | * | 3/2001 | Tsuda et al. | 399/267 |
| 2002/0022188 A1 | * | 2/2002 | Hashimoto et al. | |

FOREIGN PATENT DOCUMENTS

| | | | | |
|---|---|---|---|---|
| JP | 57-79863 | | 5/1982 | |
| JP | 58-21772 | | 2/1983 | |
| JP | 60-125868 | | 7/1985 | |
| JP | 61-275782 | | 12/1986 | |
| JP | 62-267783 | | 11/1987 | |
| JP | 5-11616 | * | 1/1993 | |
| JP | 5-011616 | | 1/1993 | |
| JP | 5-158352 | | 6/1993 | |
| JP | 5-289522 | | 11/1993 | |
| JP | 05289522 A | * | 11/1993 | G03G/15/09 |
| JP | 5-323792 | | 12/1993 | |
| JP | 6-149063 | | 5/1994 | |
| JP | 7-140730 | * | 6/1995 | |
| JP | 8-146757 | | 6/1996 | |
| JP | 10-10871 | | 1/1998 | |
| JP | 10-133481 | | 5/1998 | |
| JP | 11-143236 | | 5/1999 | |
| JP | 2000305360 A | * | 11/2000 | G03G/15/09 |

* cited by examiner

*Primary Examiner*—Susan Lee
(74) *Attorney, Agent, or Firm*—Cooper & Dunham LLP

(57) ABSTRACT

The development apparatus develops a latent image formed on a photo-conductor using a developer composed of a toner and a magnetic currier particle. A development sleeve carries the developer on an outer surface thereof so as to transfer the developer to the photo-conductor. A developer application mechanism applies the developer to the outer surface of the development sleeve. A plurality of magnets are provided inside the development sleeve so as to generate a magnetic field so that a magnetic brush is formed by the developer. The magnetic brush is brought into contact with said latent image carrier in a development area where the developer carrier is contiguous to the latent image carrier and the magnetic field between the latent image carrier and the developer separates the toner from the magnetic carrier of the magnetic brush. The wherein the magnetic brush is separated from the latent image carrier outside the development area.

26 Claims, 9 Drawing Sheets

IMAGE FORMING APPARATUS HAVING A DEVELOPMENT APPARATUS FORMING A MAGNETIC BRUSH SEPARATED FROM A LATENT IMAGE CARRIER OUTSIDE A DEVELOPMENT AREA

BACKGROUND OF THE INVENTION

1. Field of the Invention

The present invention relates to a development apparatus suitable for an electrophotographic copy machine, a laser beam printer or the like and, more particularly, to a development apparatus which develops a dot latent image formed on an image carrier by magnetic brush of a two-component developer that consists of a magnetic carrier and a toner, and an image forming apparatus provided with such a development apparatus.

2. Description of the Related Art

Generally, an electrophotographic image forming apparatus or an electrostatic recording image forming apparatus is widely used as an image forming apparatus such as a copy machine, a printer or a facsimile machine. Such an image forming apparatus forms an electrostatic latent image on an image carrier that consists of a belt-like photo-conductor or the like.

The electrostatic latent image is transformed into a visible image by a development apparatus, and the visible image (for example, a toner image) is transferred onto a record paper. The development apparatus, which visualizes the electrostatic latent image on the image carrier, requires an easy transfer capability, a half-tone reproducibility, a development property stability with respect to temperature and humidity, etc.

There is suggested a so-called contact-type two-component development system, which satisfies such a demand. The contact-type two-component development system performs a development by using a two-component developer by causing magnetic brush to slide on an image carrier surface, the magnetic brush consisting of a toner and a magnetic carrier. That is, in the contact-type two-component development system, the two-component developer is conveyed to a development area facing the latent image carrier in a state where the developer is in a spicate form like a brush chain standing on the latent image carrier so that the toner in the developer is supplied to an electrostatic latent-image part on the latent image carrier.

The development apparatus using the contact-type two-component development system has a problem in that the toner concentration in the developer must be controlled and an agitation mechanism for the developer is needed, which increases the size of the apparatus. However, the development apparatus using the contact-type two-component development system is superior to other apparatuses in obtaining a high image quality, easy conveyance of developer, etc, and, thereby, many development apparatuses use the contact-type two-component development system.

FIG. 1 is an illustrative cross-sectional view of the above-mentioned contact-type two-component development apparatus.

The development apparatus shown in FIG. 1 comprises a development roller 41 having a magnetic roller 44 and a development sleeve 43 rotatable around the magnet roller 44. The magnet roller 44 is provided with a plurality of magnetic poles, and is formed in a cylindrical shape. A development area of the developer carrier surface of the magnet roller 44 is provided with development main magnetic pole which causes the developer to stand in a spicate or ear-like form. A doctor blade 45 and a screw 47 are provided around the sleeve 43. The screw 47 supplies the two-component developer to an outer surface of the sleeve 43. The doctor blade 45 controls the thickness of the developer layer of the two-component developer adhering on the outer surface of the sleeve 43. Thereby, the developer layer having an appropriate thickness is formed on the sleeve 43.

The developer layer forms so-called magnetic brush, which is formed by the magnetic carrier extending in a spicate or ear-like form along magnetic field lines formed by the magnet roller 44. The developer extending from the outer surface of the sleeve 43 moves when at least one of the sleeve 43 and the magnet roller 44 rotates. The developer conveyed to the development area extends along magnetic field lines generated by the development main magnetic pole, and the magnetic brush of the developer contacts a surface of a latent image carrier 1 in a position facing the latent image carrier 1 so that the magnetic brush of the developer wipes the surface of the latent image carrier 1. The magnetic brush in contact with the surface of the latent image carrier 1 supplies a toner to the latent image carrier 1, while rubbing a portion where an electrostatic latent image is formed, based on a difference in the relative linear velocity between the sleeve 43 and the latent image carrier 1.

However, in the above-mentioned development apparatus, it is difficult to simultaneously establish a development condition for increasing the image concentration and a development condition for achieving a low-contrast image. That is, it is difficult to improve both a high-concentration section and a low-concentration section simultaneously. As for the development condition to increase an image concentration, it is considered to 1) reduce a development gap, which is a distance between the latent image carrier and the developer carrier or 2) increase a width of the development area. On the other hand, as for the development condition to achieve a low-contrast image, it is considered to 3) increase the development gap or 4) decrease the width of the development area. That is, the development conditions are opposite to each other and are incompatible with each other, and it is generally difficult to achieve a good image by satisfying both conditions over a whole concentration range. For example, if an importance is given to a low-contrast image, the image concentration cannot be made high. Moreover, a so-called "rear end missing" tends to occur, which is a white part formed at the end of a cross part of solid lines, a black solid part or a halftone solid image. Furthermore, there may occur a phenomenon in that a horizontal line of a grid image formed by the same width is thinner than a vertical line, or a small point image such as single dot image is not developed.

In order to solve the above-mentioned problems, there is suggested a method of setting a main pole angle of the magnet roller to an upstream side. Additionally, Japanese Laid-Open Patent Application No. 07-140730 suggested a method of giving a fixed relation between a distance between a regulation member (a member which regulates an ear height of the magnetic brush) and the development sleeve and a distance between the belt-like photo-conductor and the development sleeve.

Moreover, an improvement in the development capability of the two-component development apparatus is also a subject to be achieved. Various methods have been suggested to achieve the improvement in the development capability.

Japanese Patent Publication No. 02-59995 discloses a method of improving the development capability by bringing a magnetic pole adjacent to the development main pole closer to the development main pole. According to this method, although the concentration of a horizontal line falls (the same phenomenon as the above-mentioned thinning of the horizontal line), the decrease in the concentration is prevented by weakening the magnetic brush by lowering the saturation magnetization of the carrier. In addition, Japanese Laid-Open Patent Application No. 06-149063 suggests a non-contact two-component development apparatus using a pole arrangement in which the magnetic brush does not contact a photo-conductor. In order to prevent the "rear end missing" caused by a counter charger or a thinning phenomenon of a line image or a point image, it is suggested to reduce a velocity ratio relative to a photo-conductor. However, if the velocity ratio is reduced, an amount of developer supplied to a development nip portion per unit time decreases. Thereby, development capability declines and the fault arises that a sufficient image concentration cannot be obtained.

In a development apparatus disclosed in Japanese Laid-Open Patent Application No. 07-140730, in order to eliminate the thinning of a horizontal line (thin line omission), a ratio of Hcut to Dsd is set within a range of $1.2<Dsd/Hcut<1.6$, where Hcut is a distance between a restriction member and a development sleeve and Dsd is a distance between the development sleeve and the belt-like photo-conductor. However, as a value of Dsd/Hcut goes away from 1 (Hcut becomes smaller than Dsd), the density of the magnetic brush is decreased in the maximum proximity part between the development sleeve and the photo-conductor. For this reason, contact of the magnetic brush to the belt-like photo-conductor becomes uneven, and a part, which is not wiped by the magnetic brush, is generated on the photo-conductor. This may cause a phenomenon in which a part of dots becomes small in its size or totally eliminated especially in an isolated dot image (for example, an image in which a dot of 600 dpi is written at intervals of 5–10 pixels). If the isolated dot is not uniformly reproduced, reproducibility of a so-called high-contrast part deteriorates, which results in formation of an image having a high-contrast part with a poor gradation. In addition, in a half-tone image having a concentration about 0.3–0.8 (ID), since the contact of the magnetic brush is uneven, a feeling of roughness is enhanced, which causes deterioration of image.

Moreover, there is a problem shown in FIG. 1. FIG. 1 is a cross-sectional view of a development area of the conventional image forming apparatus. FIG. 1 illustrates a state where the magnetic brush B contacts with a latent image carrier 1. In FIG. 1, since the height of spikes or ears, the configuration or the density of the magnetic brush B is uneven, there may occur unevenness of concentration or roughness in the developed image. By adjusting an arrangement or a configuration of the doctor blade (developer regulation member), variation in the distance between the spikes or ears of the magnetic brush B can be improved. However, since a magnetic pole exists after passing through the doctor blade and before reaching the development area, it is difficult to align the extreme ends of the spikes or ears of the magnetic brush as shown in FIG. 1. It is considered that the cause of the above-mentioned problem is variation in the grain size of the carrier, variation in permeability, or a number of toners or a state of adhesion differing between carriers.

Japanese Patent Publication No. 02-59995 suggests a method of preventing decease in the concentration of a horizontal line by lowering the saturation magnetization of a carrier. However, when the saturation magnetization of a carrier is lowered, a so-called carrier adhesion may tend to be generated. Moreover, when an amount of electric charge of the toner is decreased so as to prevent the carrier adhesion, an amount of non-charged toner is increased, and so-called background roughness may be generated. Since the technique disclosed in Japanese Laid-Open Patent Application No. 06-149063 relates to a non-contact two-component development, an intensity of a development electric field is low, and it is difficult to raise development capability.

Moreover, in order to acquire an image without unevenness of concentration and roughness of the image, various measures are taken so as to uniformize an amount of developer existing in a development area. For example, in order to densify the ear of the magnetic brush, Japanese Laid-Open Patent Application No. 5-289522 suggests an arrangement of a uniformizing member in the development area for the purpose of increasing the density of the developer in the development area. Japanese Laid-Open Patent Application No. 11-143236 suggests a technique which improves nonuniformity of the thickness of the developer layer after being passed through the developer regulation member due to a decrease in the magnitude of magnetization and an increase in the density of the developer when a small size carrier is used, and which extracts a relational expression between a carrier size and a magnetic pole facing a magnetic field. Furthermore, Japanese Laid-Open Patent Applications No. 8-146757, No. 5-11616, No. 5-158352, and No. 10-10871 suggest a technique using a magnetic material or a magnet as the restriction member so as to control fluctuation in an amount of developer after being passed through the restriction member. Moreover, Japanese Patent publications No. 7-92626 and No. 7-107618 and Japanese Laid-Open Patent Applications No. 5-323792 and No. 10-133481 disclose a technique which prevents fluctuation in an amount of developer after being passed through the restriction member due to fluctuation in a restriction gap between the restriction member and the development sleeve by arranging the restriction member at a position considering a magnetic distribution.

However, there is a problem in that the above-mentioned conventional techniques cannot provide a sufficiently high image quality since they merely control fluctuation in an amount of developer with respect to passage of time or merely increase the density of developer in a development area.

Furthermore, in the above-mentioned development apparatus using the magnetic brush development method, in order to perform uniform development without unevenness in concentration, it is required to maintain a uniform thickness of the developer layer formed on the development sleeve so as to be conveyed to the development area. This is particularly important in the non-contacting development method. With respect to one-component magnetic toner, Japanese Laid-Open Utility Model Application No. 57-79863 and Japanese Laid-Open Patent Application No. 58-21772 suggest a technique to form a magnetic field having a plurality of peaks and provide a developer layer restriction member between the adjacent peaks. However, the above-mentioned technique alone provides little effect with respect to the two-component magnetic developer.

SUMMARY OF THE INVENTION

It is a general object of the present invention to provide an improved and useful image forming apparatus in which the above-mentioned problems are eliminated.

A more specific object of the present invention is to provide an image forming apparatus which can eliminate a thinning of a horizontal line and a rear end missing, prevent an isolation dot from being omitted or deterioration in a feeling of roughness in a half-tone image due to uneven contact of the magnetic brush, and prevent generation of carrier adhesion so as to maintain a high development capability.

It is another object of the present invention to provide an image forming apparatus which can eliminate fluctuation in concentration and roughness of an image by aligning the heights of spikes or ears of the magnetic brush.

A further object of the present invention is to provide an image forming apparatus which can eliminate fluctuation in concentration and roughness of an image by forming a dense magnetic brush.

In order to achieve the above-mentioned objects, there is provided according to one aspect of the present invention a development apparatus for developing a latent image formed on a latent image carrier using a developer composed of a toner and a magnetic currier particle, comprising: a hollow developer carrier which carries the developer on an outer surface thereof so as to transfer the developer to the latent image carrier; a developer application mechanism which applies the developer to the outer surface of said developer carrier; and magnetic field generating means provided inside said developer carrier for generating a magnetic field so that a magnetic brush is formed by the developer on the outer surface of said development carrier, the magnetic brush being brought into contact with said latent image carrier in a development area where the developer carrier is contiguous to the latent image carrier and the magnetic field between the latent image carrier and the developer separates the toner from the magnetic carrier of the magnetic brush, wherein the magnetic brush is separated from the latent image carrier outside the development area.

The development apparatus according to the present invention may further comprise a first developer regulation member which contacts the magnetic brush formed on the developer carrier so as to regulate a height of each spike of the magnetic brush formed on the developer carrier, the first developer regulation member located on an upstream side in a direction of conveying the developer by the developer carrier within a predetermined range from a position, at which an intensity of a magnetic field formed by a magnetic pole of the magnetic field facing the development area in a normal direction of the outer surface of the developer carrier, to the developer area.

Additionally, the development apparatus may further comprise a second developer regulation member located on an upstream side of the first developer regulation member in the direction of conveying the developer by the developer carrier, the second developer regulation member contacting the developer on the outer surface of the developer carrier so as to regulate a thickness of a layer of the developer on the outer surface of the developer carrier.

The first and second developer regulation members may be made of a nonmagnetic material. The first and second developer regulation members may be made of a conductive material so that a voltage is supplied to the first and second developer regulation members. The first and second developer regulation member may have a plate-like shape or a cylindrical shape.

Additionally, the magnetic field formed by the magnetic field generating means may be such that the magnetic brush occupies more than a predetermined part of a space defined by the outer surface of the developer carrier and a closed surface defined by tips of spikes of the magnetic brush. When the latent image carrier is removed from the development apparatus, the magnetic field formed by the magnetic field generating means may be such that a number of spikes forming the magnetic brush on the outer surface of the developer carrier is 30 pieces/mm$^2$ per unit area in a part to be opposite to the latent image carrier.

In the development apparatus according to the present invention, an intensity of magnetization of the magnetic carrier forming the magnetic brush is preferably equal to or less than 60 emu/g, and more preferably be equal to or less than 40 emu/g. Additionally, an average particle diameter of the magnetic carrier forming the magnetic brush may fall within a range from 30 $\mu$m to 100 $\mu$m.

Additionally, there is provided according another aspect of the present invention an image forming apparatus comprising: a latent image carrier which carries a latent image to be developed; and a development apparatus for developing the latent image formed on the latent image carrier using a developer composed of a toner and a magnetic currier particle, comprising: a hollow developer carrier which carries the developer on an outer surface thereof so as to transfer the developer to the latent image carrier; a developer application mechanism which applies the developer to the outer surface of said developer carrier; and magnetic field generating means provided inside said developer carrier for generating a magnetic field so that a magnetic brush is formed by the developer on the outer surface of said development carrier, the magnetic brush being brought into contact with said latent image carrier in a development area where the developer carrier is contiguous to the latent image carrier and the magnetic field between the latent image carrier and the developer separates the toner from the magnetic carrier of the magnetic brush, wherein the magnetic brush is separated from the latent image carrier outside the development area.

In the image forming apparatus according to the present invention, the latent image carrier may be a photo-conductor belt. Additionally, A distance between the latent image carrier and the developer carrier may be three to ten times a particle diameter of the magnetic carrier. Further, a ratio of a linear velocity of the developer carrier to a linear velocity of the latent image carrier may be preferably smaller than 4, and more preferably close to 1.05.

Other objects, features and advantages of the present invention will become more apparent from the following detailed description when read in conjunction with the accompanying drawings.

DETAILED DESCRIPTION OF THE PREFERRED EMBODIMENTS

First Embodiment

Figure 1:
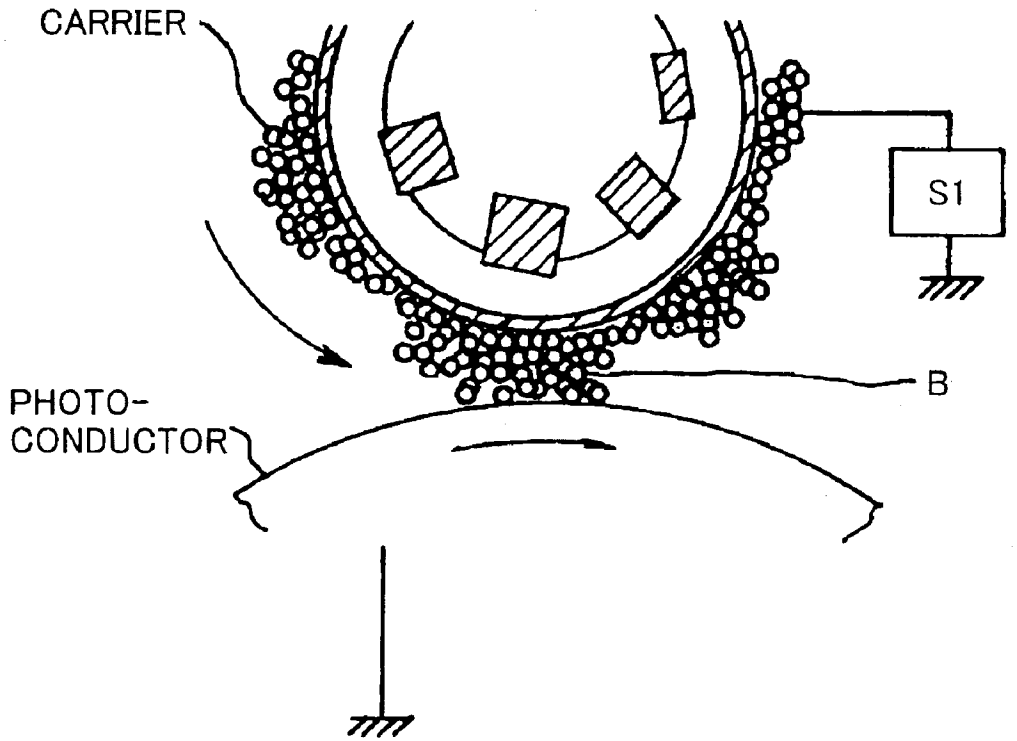
FIG.1 PRIOR ART
FIG. 1 is an illustrative cross-sectional view of a contact-type two-component development apparatus.
Figure 2:
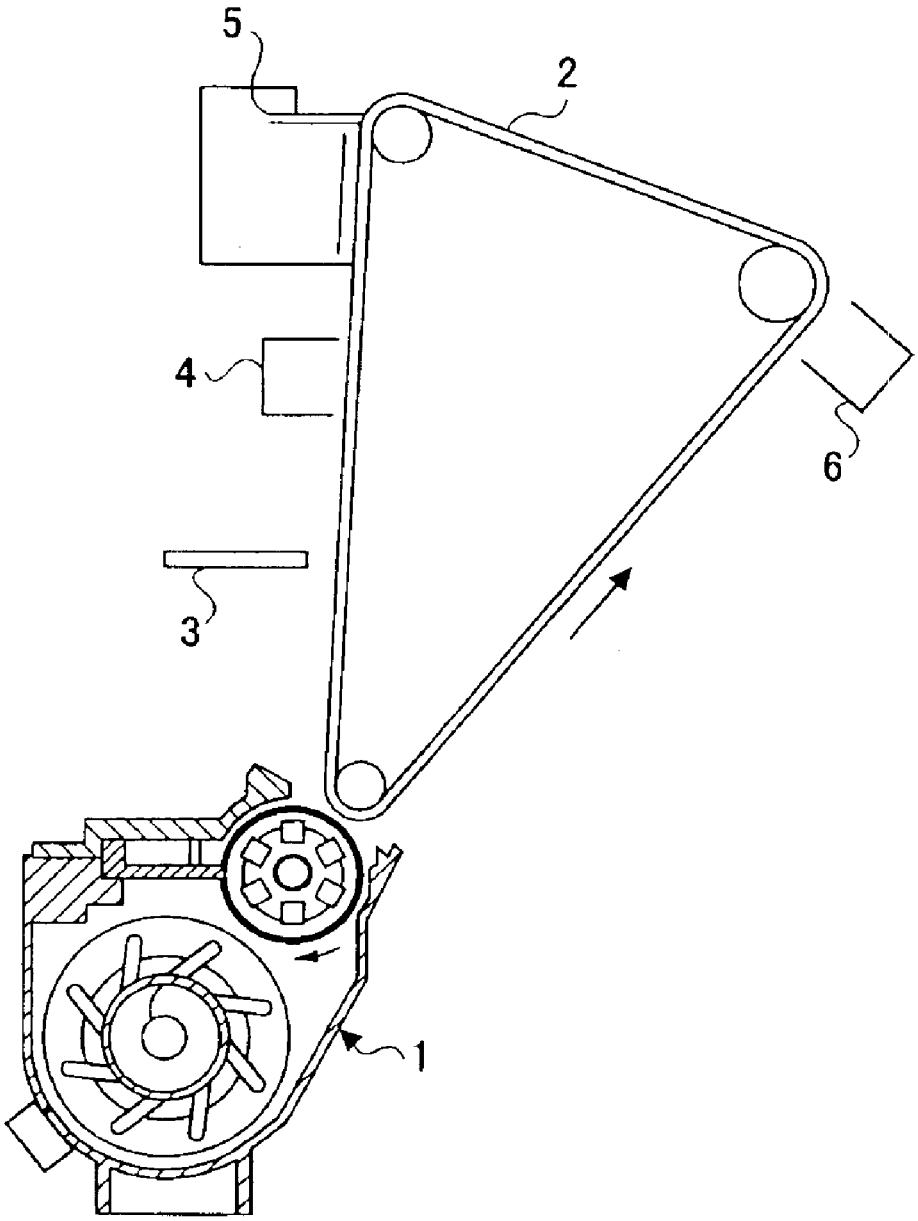
FIG. 2 is an illustration showing a structure of an image forming apparatus according to a first embodiment of the present invention.

A description will now be given of a first embodiment of the present invention. FIG. 2 is an illustration showing a structure of an image forming apparatus according to the first embodiment of the present invention.

In FIG. 2, a development apparatus 1, an exposure apparatus 3, an electric-charge apparatus 4, a cleaning apparatus 5 and a transfer apparatus 6 are arranged around the belt photo conductor 2, which serves as an electrostatic latent-image carrier. The electric charge apparatus 4 charges a surface of the photo-conductor belt 2. The exposure apparatus 3 irradiates a laser beam onto the surface of the photo-conductor belt 2 so as to form a latent image on the uniformly charged surface of the photo-conductor belt 2.

The development apparatus 1 forms a toner image by adhering a charged toner to the latent image on the surface of the photo-conductor belt 2. The transfer apparatus 6 transfers the toner image formed on the photo-conductor belt 2 to a record paper. The cleaning apparatus 5 removes a remaining toner on the photo-conductor belt 2. A cathode electrode apparatus (not shown in the figure) is also arranged around the photo-conductor belt 2 so as to remove the remaining electric charge on the photo-conductor belt 2.

In the above-mentioned structure, the surface of the photo-conductor belt 2 is uniformly charged by a charge roller of the electric charge apparatus 4, which comprises the charge roller contacting the photo-conductor belt 2 and a power source applying a voltage to the charge roller. An electrostatic latent image is formed on the charged photo-conductor belt 2 by the exposure apparatus 3, which irradiates a laser beam generated by a laser diode onto the photo-conductor belt 2 while deflecting the laser beam by a polygon mirror.

The development apparatus 1 transforms the electrostatic latent image into a toner image by supplying a toner. The toner image on the surface of the photo-conductor belt 2 is transferred to a record paper fed from a paper supply tray (not shown in the figure) by the transfer apparatus 6, which comprises a transfer belt and a power source. The voltage applied to the transfer belt is controlled by electric current control of about 30 $\mu$A.

During the transfer, the record paper adhering to the photo-conductor belt 2 is separated from the photo-conductor belt 2 by a separation claw. Then, unfixed toner image on the record paper is fixed by a fixing apparatus. On the other hand, a toner that is not transferred to the record paper and remains on the photo-conductor belt 2 is removed by the cleaning apparatus 5 which has a blade formed of an elastic body. The photo-conductor belt 2 from which the remaining toner has been removed is initialized by a charge removal lamp (not shown in the figure), and the photo-conductor belt 2 is subjected to a subsequent image forming process.

Figure 3:
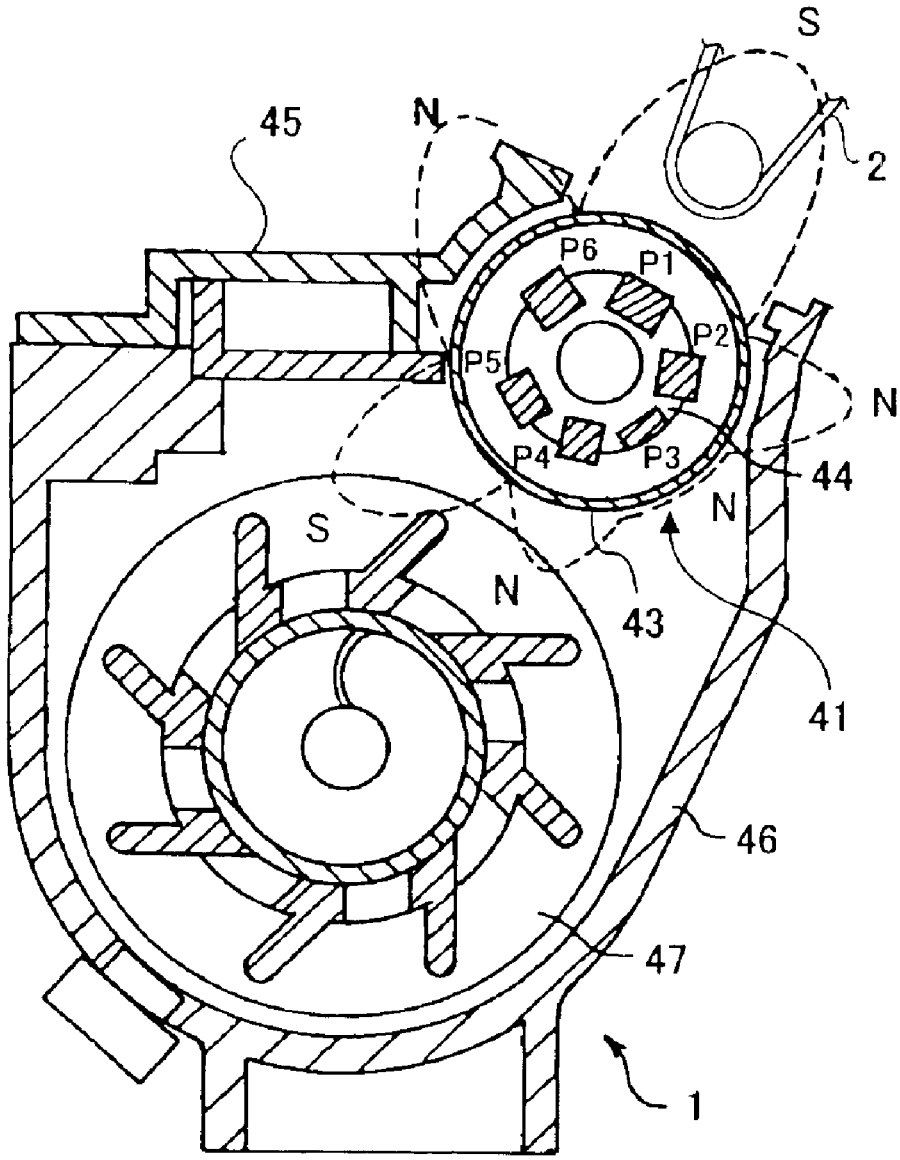
FIG. 3 is a cross-sectional view of the development apparatus 1 shown in FIG. 2.

FIG. 3 is a cross-sectional view of the development apparatus 1 shown in FIG. 2. In the development apparatus 1, a developing roller 41, which serves as a development carrier, is arranged in the vicinity of the photo-conductor belt 2. A development area is formed in a part in which the developing roller 41 and the photo-conductor belt 2 face each other. A development sleeve 43 is provided inside the developing roller 41. The development sleeve 43 has a cylindrical shape and is formed of a non-magnetic material such as aluminum, brass, stainless steel or conductive resin. The development sleeve 43 is rotated in clockwise direction by a rotating mechanism (not shown in the figure).

In the present embodiment, a linear velocity of the photo-conductor belt 2 is set to 240 mm/sec. The diameter of the development sleeve 43 is 20 mm, and a linear velocity of the sleeve 43 is set to 600 mm/sec. Therefore, the ratio of the linear velocity of the photo conductor 2 to the linear velocity of the sleeve 43 is 2.5. Moreover, a development gap corresponding to a distance between the photo-conductor belt 2 and the development sleeve 43 is set to 0.4 mm. Generally, the development gap is set to 0.65 mm to 0.8 mm when the carrier particle diameter or size is 50 $\mu$m. In other words, the development gap is set to more than ten times the carrier particle diameter.

However, in the present embodiment, it is preferable to set the development gap to about three to ten times the carrier particle diameter. If the development gap is equal to or less than two times the carrier particle diameter, a restraint force generated by a magnet of the magnetic roller is strong, which hardens the magnetic brush formed. Therefore, an elasticity of the magnetic brush with respect to the image carrier is lost, and there is a problem in that a trace of spikes or eras of the magnetic brush is formed in the toner image. On the other hand, if the development gap is equal to or greater than eleven times the carrier particle diameter, there is a problem in that a desired concentration cannot be achieved or the carrier may scatter. Even if the ratio of the linear velocity of the sleeve to the linear velocity of the photo conductor is lowered to 1.05 at minimum, a desired image concentration can be obtained.

On an upstream part of the development area in the conveyance direction of the developer (a clockwise direction in the figure), there is provided a doctor blade 45, which regulates a height of the spikes or ears of the chains of developer. That is, the doctor blade 45 restricts an amount of the developer adhering on the development sleeve. A doctor gap, which is a distance between the doctor blade 45 and the development sleeve 43, is set to 0.4 mm. It is preferable to set a ratio of the development gap to the doctor gap to 0.8 to 1.

If the ratio of the development gap to the doctor gap is less than 0.8, there may be a problem caused by the developer staying in an area where the development carrier and the latent image carrier face each other by being retained by the latent image carrier. On the other hand, when the ratio of the development gap to the doctor gap is greater than 1, there is a possibility that a part in which the magnetic brush of the developer cannot contact the latent image carrier arise, which may results in generation of an image defect.

Furthermore, a screw 47 is provided in a casing 46 in which the developing roller 41 is accommodated. The screw 47 pumps up the developer inside the casing 46 while agitating the developer. In the casing 46, the toner and the magnetic carrier are mixed and agitated by the rotating screw 47 driven by a drive means (not shown in the figure) at 500 rpm, and the toner is charged by friction. An amount (q/m) of electric charge of the toner is −5 to −60 μC/g, preferably, −10 to −30 μC/g.

A magnet roller 44 is provided inside the development sleeve 43 in a fixed state. The magnet roller 44 forms a magnetic field so that the developer forms spikes or ears extending from an outer surface of the development sleeve 43. The carrier contained in the developer forms chain like spikes or ears, which extend along magnetic field lines in a normal direction-generated by the magnet roller 44 in a normal direction. The charged toner adheres the chain-like spikes or ears, which forms the magnetic brush.

The magnetic brush is transported by the rotation of the development sleeve 43 in the same direction as the rotation of the development sleeve 43. The magnet roller 44 has a plurality of magnetic poles (magnets). Specifically, the magnet roller 44 comprises: a development main magnet P1 which forms the spikes or ears of the developer in the development area; a magnet P4 which pumps up the developer onto the development sleeve 13; magnets P5 and P6 which convey the pumped-up developer to the development area; and magnets P2 and P3 which convey the developer in an area after development.

The magnets P1 through P5 are arranged to face in a radial direction of the development sleeve 43. Although the magnet roller 44 is constituted by the six-pole magnet as mentioned above, the magnet roller may have more than eight magnetic poles by providing additional magnets (magnetic poles) between the P3 magnet and the doctor blade 45 so as to improve the pump-up function and traceability of a black solid image.

In the present embodiment, each of the magnet P4 for pumping up the developer, the magnet P6, which conveys the pumped-up developer to the development area, and the magnets P2 and P3, which convey the developer in the area after the development, forms N pole on the development sleeve 43. On the other hand, each of the development main magnet P1 and the magnet P5, which conveys the pumped-up developer, forms S pole. It is considered that the magnet P2 on the downstream side of the main magnet also has a function to assist the formation of a main magnetic force. Therefore, when the magnetic force of the magnet P2 is too small, there is a possibility of causing carrier adhesion.

A description will now be given of the magnetic carrier (magnetic particle) used in the present embodiment. The magnetic carrier used in the present embodiment can be the same as conventional magnetic carrier. Namely, the magnetic carrier used in the image forming apparatus according to the present embodiment is preferably prepared by selecting magnetic particles having a predetermined particle diameter by a known particle-diameter selecting means. The magnetic particles can be produced by conglobating particles of a ferromagnetic material or paramagnetic material of a metal such as iron, chromium, nickel or cobalt, or those compounds or alloy such as triiron tetroxide, gamma-ferrous dioxide, chrome dioxide, manganese oxide, ferrite, or manganese-copper alloy. Or, the magnetic particles may be produced by spherically covering the surface of the aforementioned particles with styrene base resin, vinyl base resin, ethyl base resin, rosin denaturation resin, acrylics base resin, polyamide resin, epoxy resin, polyester resin, etc. Or, the magnetic particles may be produced by forming spherical particles of resin containing dispersed magnetic fine powder.

Furthermore, the magnetic carrier preferably has an intensity of magnetization equal to or less than 60 emu/g in a magnetic field of 1K oersted, more preferably equal to or less than 40 emu/g. Spherical particles are preferably used for the carrier constituting the magnetic brush so as to reduce damage to the surface of the photo conductor 2. The average diameter of the carrier may preferably be equal to or less than 150 μm. However, if the average diameter of the carrier is too large, an area which does not contact the photo conductor 2 increases even if the carrier is arranged in the maximum dense state since a radius of curvature is large. Thereby, there is a possibility that chipping or loss of the toner image may occur. Conversely, if the average diameter is too small, when impressing an AC voltage, the particles can be easily movable and exceed the magnetic force between particles. Such a condition may cause scattering of particles and carrier adhesion. Therefore, the average diameter of the carrier is preferably equal to or greater than 30 μm and equal to or smaller than 100 μm.

Furthermore, the magnetic carrier preferably has an intensity of magnetization equal to or less than 60 emu/g in a magnetic field of 1K oersted, more preferably equal to or less than 40 emu/g. If the intensity of magnetization is larger than the above-mentioned value, a thin and high spike or ear of the magnetic brush is undesirably formed. Thus, the magnetic brush becomes hard and there is a possibility of producing a problem of forming a trace of magnetic brush in an image part or forming a scratch on the photo conductor. Moreover, although it depends on the intensity of the magnet P1, it is required to produce the intensity of magnetization at which the carrier does not separate by a centrifugal force on the P1 pole. That is, if the magnetization is too weak, the carrier cannot be held by the magnet and a problem of carrier scattering may occur.

Grooves may be formed on the surface of the development sleeve 43 so as to pump up a sufficient amount of developer and uniformize the configuration of the magnetic brush. As an approach of forming the grooves on the surface of the development sleeve 43, there are a cutting method, a drawing (Direct Ironing: D-I) method, a sandblasting method, etc.

The inventors performed experiments to evaluate the image quality obtained by the image forming apparatus according to the present embodiment. The following two kinds of images were output while changing the radius of curvature of the photo-conductor belt in the area where the photo-conductor belt faces the development sleeve.

1) 1-dot vertical and horizontal lines (1-dot line of 600 dpi)

2) Grating dot image (1 cm square 600 dpi)

It should be noted that the average diameter of the magnetic carrier used was 50 micron, the intensity of magnetization was 60 emu/g, the toner concentration was 2.3 wt %, the amount of electric charge of the toner was −22.5 μC/g, and the development gap was 0.4 mm.

The linear velocity ratio of the development sleeve to the latent image carrier was set to 1.05. In addition to the above-mentioned examples, a comparative example was prepared. The comparative example was prepared used the same structure as the examples except for the photo-conductor belt being replaced by a drum photo conductor having a diameter of 30 mm.

The result of experiments is shown in the following Table 1. In Table 1, an aspect ratio represents a ratio of a width (cm) of a vertical line to a width (cm) of a horizontal line.

TABLE 1

| | Radius of curvature | Aspect ratio | Rear end missing | Black solid ID |
|---|---|---|---|---|
| Referential Example | 4 | 1.05 | ○ | 0.8 |
| Example 1 | 5 | 1.03 | ○ | 1.2 |
| Example 2 | 8 | 1.05 | ○ | 1.3 |
| Example 3 | 10 | 1.04 | ○ | 1.3 |
| Example 4 | 14 | 1.10 | ○ | 1.2 |
| Comparative Example | 15 | 1.36 | X | 1.3 |

It can be appreciated from Table 1 that, as compared to the comparative example, the images formed by the image forming apparatus according to the present embodiment did not have thinning of a horizontal line and rear end missing, and a development capability was maintained high.

Second Embodiment

Figure 4:
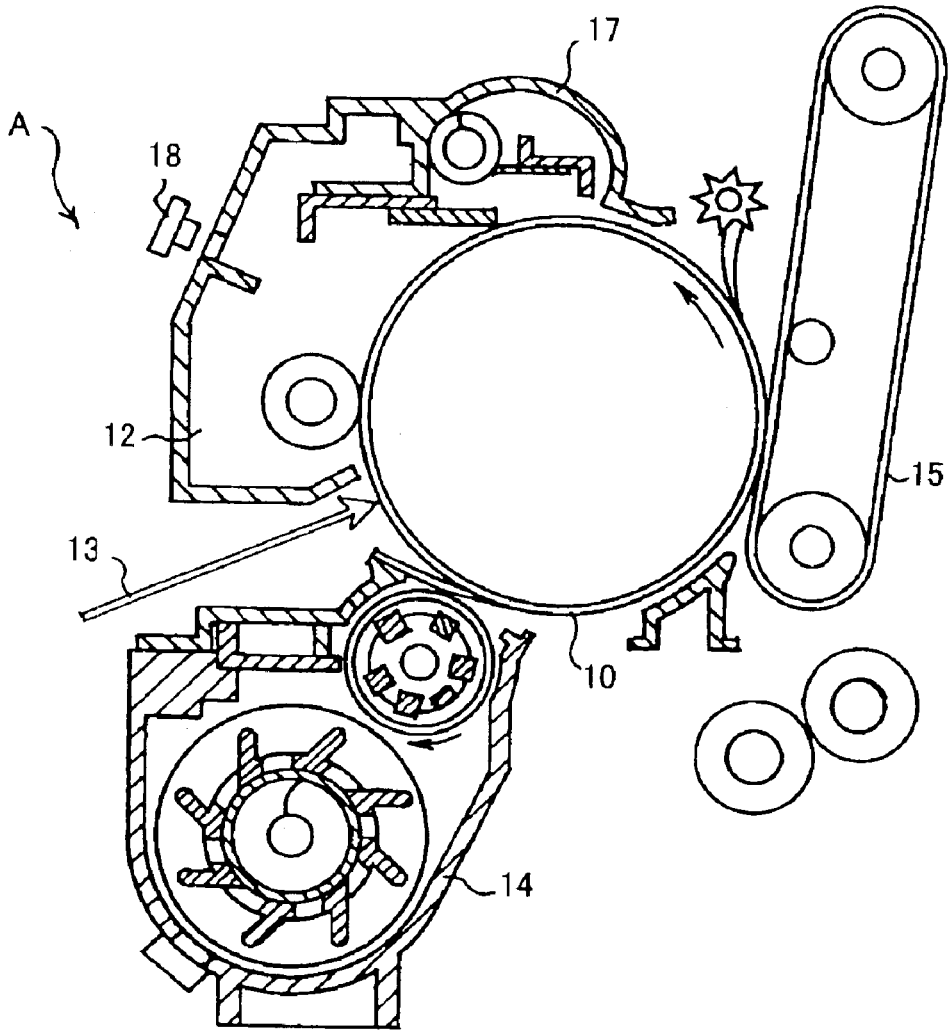
FIG. 4 is a cross-sectional view of an image forming apparatus according to a second embodiment of the present invention.

A description will now be given, with reference to FIG. 4, of a second embodiment of the present invention. FIG. 4 is a cross-sectional view of an image forming apparatus according to the second embodiment of the present invention.

The image forming apparatus according to the second embodiment of the present invention has the same fundamental structure as the structure of the image forming apparatus shown in FIG. 2. The image forming apparatus according to the second embodiment differs from the first embodiment in that the image forming apparatus according to the second embodiment is provided with means for controlling a height of spikes or ears of the magnetic brush.

Referring to FIG. 4, an electric charge apparatus 12, an exposure apparatus 13 (laser beam), a development apparatus 14, a transfer apparatus 15, a cleaning apparatus 17 and a charge removal apparatus 18 are arranged around a photo-conductor drum 10. The photo-conductor drum 10 serves as an electrostatic latent-image carrier. The electric charge apparatus 12 charges a surface of the photo-conductor drum 10. The exposure apparatus 13 irradiates a laser beam onto the surface of the photo-conductor drum 10 so as to form a latent image on the uniformly charged surface of the photo-conductor drum 10. The development apparatus 14 forms a toner image by adhering a charged toner to the latent image on the surface of the photo conductor drum 10. The transfer apparatus 15 transfers the toner image formed on the photo-conductor drum 10 to a record paper. The cleaning apparatus 17 removes a remaining toner on the photo conductor drum 2. The charge removal apparatus 18 removes the remaining electric charge on the photo-conductor drum 10.

In the above-mentioned structure, the surface of the photo-conductor drum 10 is uniformly charged by a charge roller of the charge apparatus 12, which comprises the charge roller contacting the photo conductor drum 10 and a power source applying a voltage to the charge roller. An electrostatic latent image is formed on the charged photo-conductor drum 10 by the exposure apparatus 13, which irradiates a laser beam onto the photo conductor drum 10. The development apparatus 14 transforms the electrostatic latent image into a toner image by supplying a toner. The toner image on the surface of the photo-conductor drum 10 is transferred to a record paper fed from a paper supply tray (not shown in the figure) by the transfer apparatus 15. During the transfer, the record paper adhering to the photo-conductor drum 10 is separated from the photo-conductor drum 10 by a separation claw. Then, unfixed toner image on the record paper is fixed by a fixing apparatus. On the other hand, a toner that is not transferred to the record paper and remains on the photo-conductor drum 10 is removed by the cleaning apparatus 17. The photo-conductor drum 10 from which the remaining toner has been removed is initialized by the charge removal apparatus 18, and the photo-conductor drum 10 is subjected to a subsequent image forming process.

Figure 5:
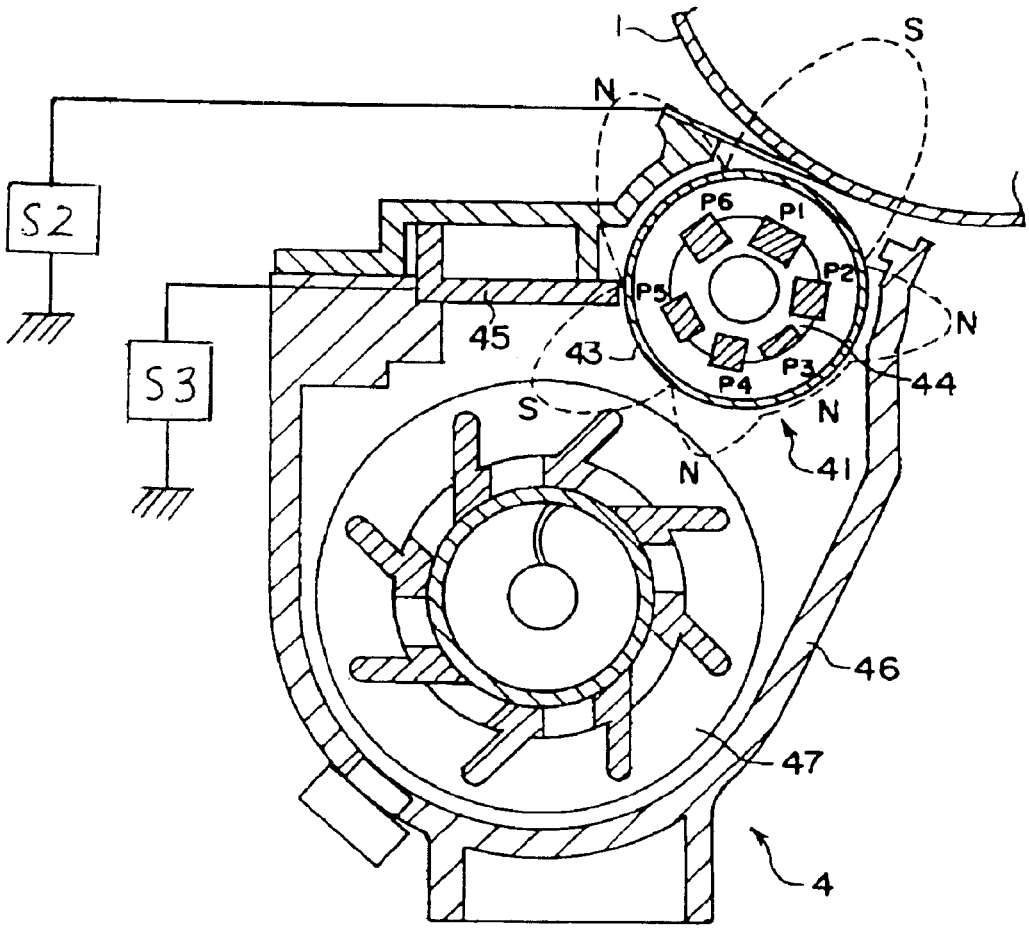
FIG. 5 is a cross-sectional view of a development apparatus shown in FIG. 4.

FIG. 5 is a cross-sectional view of the development apparatus 14 shown in FIG. 4. In FIG. 5, parts that are the same as the parts shown in FIG. 3 are given the same reference numerals and descriptions thereof will be omitted.

In FIG. 5, the doctor blade (developer regulation member) 45 is preferably formed of an elastic rubber material such as urethane or silicone. A nonmagnetic material such as aluminum, brass or stainless steel may be used to from the doctor blade 45. In order to form the magnetic brush on the development sleeve (developer carrier), grooves or unevenness are provided on the surface of the development sleeve so as to pump up a sufficient amount of developer and uniformize the configuration of the magnetic brush. As an approach of forming the grooves on the surface of the development sleeve 43, there are a cutting method, a drawing (Direct Ironing: D-I) method, a sandblasting method, etc. The drawing method has an advantage in that a plurality of grooves extending in an axial direction of the development sleeve can be easily formed by a single drawing process.

The inventors observed fluctuation in the magnetic brush in the development area in detail using a high-speed camera while changing the location of the doctor blade 45 (made from stainless steel). Specifically, the inventors observed fluctuation in the height of spikes or ears of the magnetic brush in the development area by moving the doctor blade 45 relative to the development sleeve 43 in a developer conveyance direction toward the magnetic pole P6 until the doctor blade 45 reaches a position corresponding to the magnetic pole P1.

The results of the observation showed that the magnetic brush having spikes or ears with a uniform height can be formed by locating the doctor blade 45 at a position slightly inside the development area from a position at which the spike or ears are formed at the magnetic pole P1, that is, a position at which an intensity of magnetic field of the magnetic pole P1 in a normal direction becomes zero, as shown in FIG. 5. An image visualized by the magnetic brush formed by such a structure did not have roughness in a half-tone area, and a solid concentration was high, and a high-quality image was obtained with excellent sharpness of lines and characters.

Figure 6:
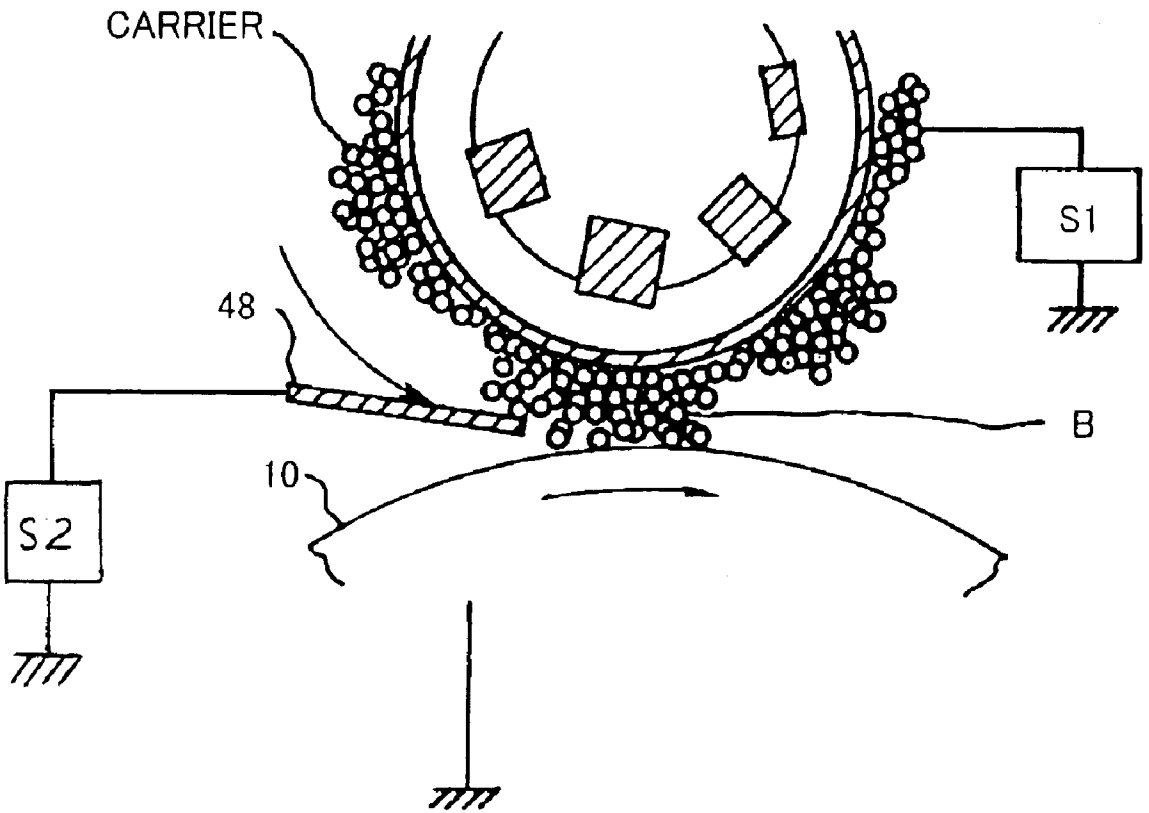
FIG. 6 is an illustration showing an additional developer regulation member.

Next, another doctor blade 48 was arranged at a location shown in FIG. 6 as an additional developer regulation member while maintaining the doctor blade 45 arranged at the position corresponding to the magnetic pole P5. As a result, it was found that the structure having the two doctor blades 45 and 48 provides easier control of the height of spikes or ears of the magnetic brush than the structure having a single doctor blade. It was also found that the above-mentioned structure is especially effective when a distance (development gap) between the developer carrier and the latent image carrier is small. Furthermore, in such as case, it was also found that there is an advantage that an amount of developer scratched by the doctor blade 48 (the first developer regulation member) is reduced. An image visualized by the magnetic brush formed by such a structure did not have roughness in a half-tone area, and a solid concentration was high, and a high-quality image was obtained with excellent sharpness of lines and characters.

Furthermore, in the above-mentioned structure having the two doctor blades 45 and 48, a DC voltage was applied to the doctor blade 48 (first developer regulation member). The voltage applied to the doctor blade 48 was −450 V while a voltage applied to the development sleeve was −550 V. It was preferable that the DC voltage applied to the doctor blade 48 be equal to or higher than the voltage applied to the development sleeve 43. If the DC voltage applied to the doctor blade 48 is lower than the voltage applied to the development sleeve 43, the toner on the carrier moves toward the surface of the development sleeve 43, which causes missing of a tip of an image and adhesion of an excessive amount of carrier on the development sleeve 43. On the other hand, if the DC voltage applied to the doctor blade 48 is extremely higher than the voltage applied to the development sleeve 43, the toner on the magnetic brush is developed on the doctor blade 48 and the toner concentration of the developer is decreased, which causes a decrease in a solid image concentration. However, since the toner moves toward a tip of the magnetic brush in the present embodiment, a high-efficiency development can be achieved. An image visualized by the magnetic brush formed by such a structure also did not have roughness in a half-tone area, and a solid concentration was high, and a high-quality image was obtained with excellent sharpness of lines and characters.

It should be noted that a voltage may be applied to the doctor blade 45 or both the doctor blade 45 and the doctor blade 48 so as to control a toner distribution on the magnetic brush.

Generally, the development gap is set to 0.65 mm to 0.8 mm when the carrier particle diameter or size is 50 $\mu$m. In other words, the development gap is set to more than ten times the carrier particle diameter. However, in the present embodiment, the development gap can be set as large as about thirty times the carrier particle diameter. If the development gap is larger than thirty times the carrier particle diameter, a desired image quality may not be obtained. Additionally, a necessary image concentration can be achieved even if the ratio of the linear velocity of the development sleeve to the linear velocity of the photo-conductive drum is decreased to 1.1 at minimum.

In the present embodiment, the main magnet P1 for forming a development main magnetic pole is constituted by a magnet having a small horizontal cross-section. The main magnet P1 is preferably formed of a samarium of a samarium alloy magnet, especially a samarium cobalt alloy magnet, etc. The maximum energy products of the ferrite magnet and the ferrite bond magnet used in the conventional development apparatus are about 36 kJ/m$^3$ and about 20 kJ/m$^3$, respectively. The maximum energy product of an iron-neodymium-boron alloy magnet, which is a typical magnet among rare earth metal alloy magnets, is 358 kJ/m$^3$. The maximum energy product of an iron-neodymium-boron alloy bond magnet is about 80 kJ/m$^3$. By using such a magnet, unlike the conventional magnet, a required magnetization of the developing-roller surface can be acquired even if the magnet is miniaturized very much. When increasing the diameter of the sleeve is permitted, it is possible to narrow a half-value center angle by using a large size ferrite magnet or a ferrite bond magnet and forming a small tip of the magnet facing the sleeve.

Additionally, the carrier (magnetic particles) preferably has a resistivity equal to or smaller than $10^{14}$ Ωm, more preferably equal to or greater than $10^1$ Ωm and equal to or smaller than $10^8$ Ωm. If the resistivity of the carrier is too low, the carrier is electrically charged by the development bias voltage, which may cause the carrier adhering onto the photo-conductor or a dielectric breakdown of the photo-conductor due to the development bias voltage.

Figure 7:
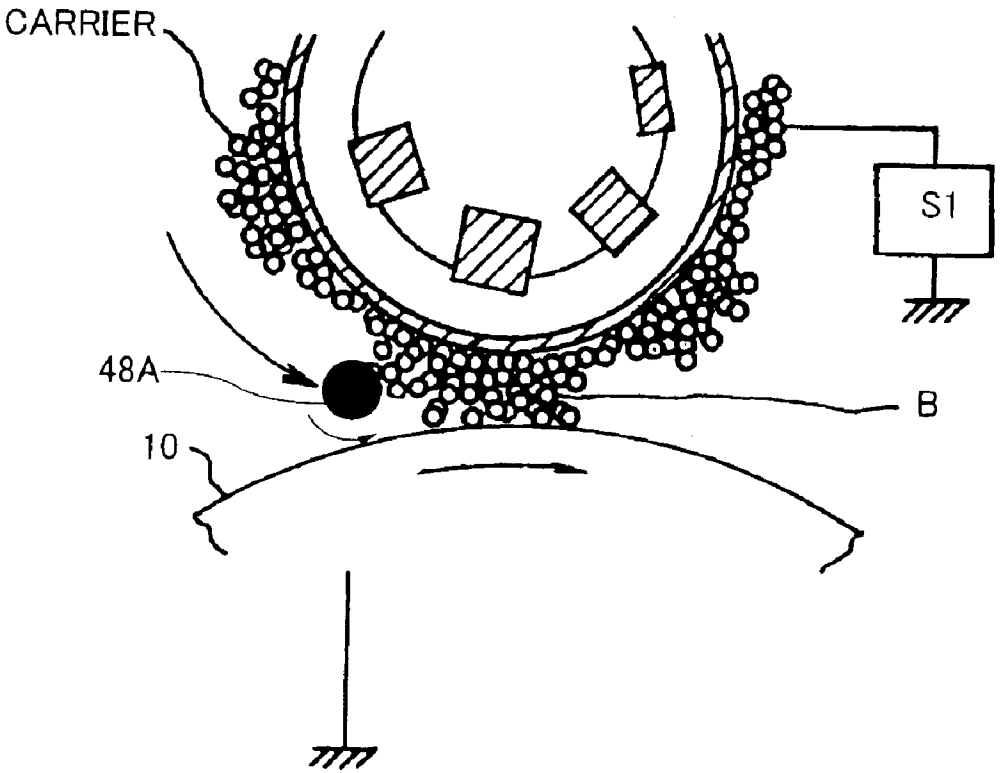
FIG. 7 is an illustration of a variation of the first developer regulation member.

In FIG. 6, the doctor blade 48 (first developer regulation member) has a plate-like form. However, the form of the first developer regulation member is not limited to the plate-like form, and other forms may be used. FIG. 7 shows a variation of the first developer regulation member. In FIG. 7, the first developer regulation member 48A is formed in a cylindrical shape. The first developer regulation member 48A is rotatable in a direction opposite to a direction of rotation of the development sleeve 43. The rotation of the first developer regulation member 48A is efficiently controls (uniformizes) the height of spikes or ears of the magnetic brush. Additionally, there is an effect that the toner adhering on the first developer regulation member 48A during uniformizing the height of spikes or ears can be returned to the carrier by the rotation of the first developer regulation member 48A.

Third Embodiment

A description will now be given of a third embodiment of the present invention. An image forming apparatus according to the third embodiment of the present invention has the same fundamental structure as the image forming apparatus according to the second embodiment of the present invention except for the first development restriction member of the development apparatus is eliminated. Instead of providing the first development restriction member, in the third embodiment, material of the carrier (magnetic particles) is selected so as to control the configuration of the magnetic brush.

The inventors observed the developer on the development sleeve 43, especially in the process of conveying the developer after passing through the doctor blade 45 until reaching the development area in detail by using a high-speed camera. According to the observation, it was found that even if a thickness or amount of developer after being passed through the doctor blade is controlled with high accuracy, roughness occurs in a gradation image such as a half-tone image. It was considered that the cause of the roughness is in the movement of the magnetic brush. That is, even if a thickness or amount of developer is controlled after being passed through the doctor blade 45, the magnetic brush extends or protrudes outwardly at and near the position where the magnetic force generated by the magnet P6 in a normal direction becomes maximum and then again pressed by being attracted toward the surface of the development sleeve 43 and conveyed to the development area.

Figure 8:
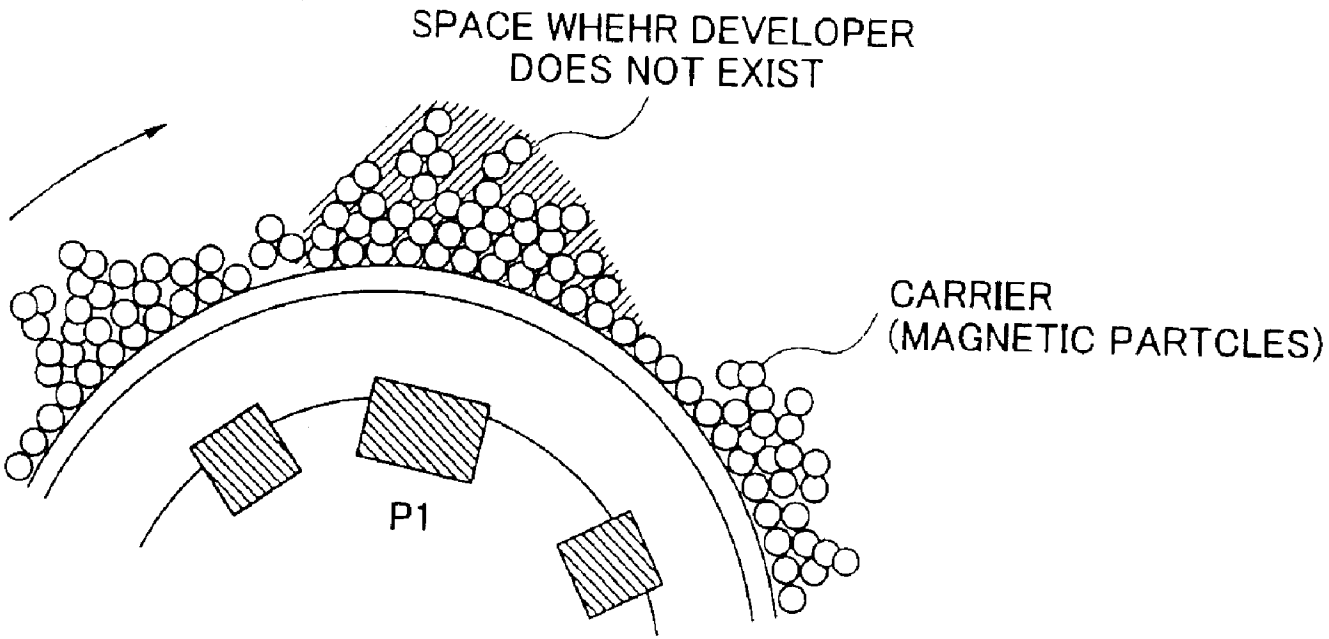
FIG. 8 is an illustration for explaining a space where the magnetic brush is not present.

Thus, in the present embodiment, a consideration is given to the formation process of the magnetic brush in the development area. That is, in the present embodiment, the quality of image is improved by controlling the configuration of the magnetic brush. More specifically, in the image forming apparatus shown in FIG. 4, the photo-conductor drum 10 (latent image carrier) was removed so as to observe the formation process of the magnetic brush by the high-speed camera while rotating the development sleeve 43 (developer carrier) at a normal speed and moving the high-speed camera in a longitudinal direction of the development sleeve 43. According to the results of observation, it was found that when a hatched part of the magnetic brush shown in FIG. 8 is small, a high-quality image having less roughness in a half-tone area, a high concentration solid image and an excellent sharpness of lines and characters. The hatched part of FIG. 8 corresponds to a space defined by a closed surface and the surface of the development sleeve 43, the closed surface including a tip of each spike or ear of the magnetic brush in the development area.

EXAMPLE 1

P1 pole was set up so that the flux density on the development sleeve 43 is 950 G. Magnetic particles having a ferrite core were used as the magnetic carrier of the developer. An average diameter of the magnetic particles was 35 $\mu$m. An intensity of magnetization of the magnetic particles in the magnetic field of 1 KOe was 40 emu/g. The developer was prepared by mixing a nonmagnetic toner with the magnetic carrier by 5 wt %. Development was carried out using the thus-prepared developer.

Figure 9:
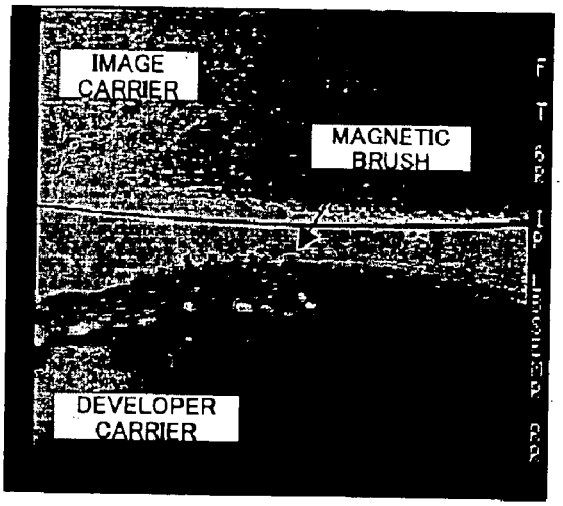
FIG. 9 shows results of observation of the magnetic brush formed within a development area.

FIG. 9 shows results of the observation of the magnetic brush formed within the development area. The number of spikes or ears of the magnetic brush per unit area in the development area was 49 pieces/mm$^2$. According to the thus-formed brush, the formed image had no roughness in a half-tone area, a high concentration in a solid image and an excellent sharpness of lines and characters.

COMPARATIVE EXAMPLE

Figure 10:
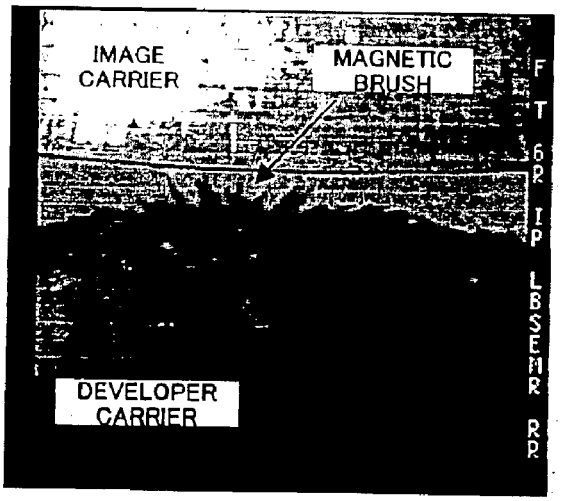
FIG. 10 shows results of observation of the magnetic brush formed within a development area.

In the above-mentioned Example 1, the magnetic carrier was replaced by one having an intensity of magnetization of 65 emu/g in the magnetic field of 1 KOe, and development was carried out. Consequently, the magnetic brush shown in FIG. 10 was formed.

Compared with Example 1, it was found that the length of spikes or ears of the magnetic brush is longer than that of the Example 1, and the space defined by the closed surface and the surface of the development sleeve was larger than that of the Example 1. This was caused by the spikes or ears of the magnetic brush becoming thin and long due to an increase in the intensity of magnetization of the carrier. At this time, the number of spikes or ears of the magnetic brush per unit area in the development area was 25 pieces/mm$^2$. With such a magnetic brush, the dot reproducibility in a low concentration part was bad, and the image formed had roughness in a half-tone area.

EXAMPLE 2

The magnetic carrier of Example 1 was replaced by one having an average particle diameter of 50 micron and an intensity of magnetization of 60 emu/g in the magnetic field of 1 KOe, and development was carried out. Additionally, a magnetic toner containing a magnetic material by 30% was used as the toner mixed with the magnetic carrier.

Development was carried out in the same manner as Example 1.

Figure 11:
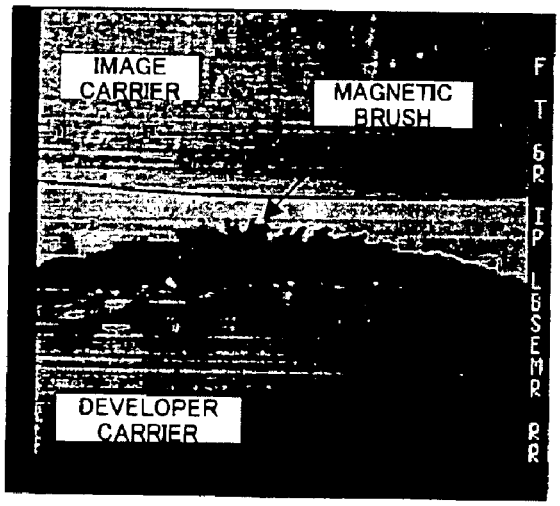
FIG. 11 shows results of observation of the magnetic brush.

FIG. 11 shows results of observation of the magnetic brush. At this time, the number of spikes or ears of the magnetic brush was 36 pieces/mm$^2$. According the thus-formed magnetic brush, the formed image had no roughness in a half-tone area, a high concentration in a solid image and an excellent sharpness of lines and characters.

The present invention is not limited to the above-mentioned embodiments, and variations and modifications may be made without departing from the scope of the present invention.

The present application is based on Japanese Priority Applications No. 2001-079798 filed on Mar. 21, 2001 and No. 2001-085621 filed on Mar. 23, 2001, the entire contents of which are hereby incorporated by reference.

What is claimed is:

1. A development apparatus for developing a latent image formed on a latent image carrier using a developer composed of a toner and a magnetic currier particle, comprising:

a hollow developer carrier which carries the developer on an outer surface thereof so as to transfer the developer to the latent image carrier;

a developer application mechanism which applies the developer to the outer surface of said developer carrier; and magnetic field generating means provided inside said developer carrier for generating a magnetic field so that a magnetic brush is formed by the developer on the outer surface of said development carrier, the magnetic brush being brought into contact with said latent image carrier in a development area where the developer carrier is contiguous to the latent image carrier and the magnetic field between the latent image carrier and the developer separates the toner from the magnetic carrier of the magnetic brush, wherein the magnetic brush is separated from the latent image carrier outside the development area, and wherein said development area is formed between a round part of said latent image carrier having a radius of curvature and said developer carrier, and the radius of curvature is set to a value at which a high development capability is maintained in the development area.

2. The development apparatus as claimed in claim 1, further comprising a first developer regulation member which contacts the magnetic brush formed on the developer carrier so as to regulate a height of each spike of the magnetic brush formed on the developer carrier, the first developer regulation member located on an upstream side in a direction of conveying the developer by the developer carrier within a predetermined range from a position, at which an intensity of a magnetic field formed by a magnetic pole facing the development area in a normal direction of the outer surface of the developer carrier becomes zero, to the developer area.

3. The development apparatus as claimed in claim 2, wherein said first developer regulation member is made of a nonmagnetic material.

4. The development apparatus as claimed in claim 2, wherein said first developer regulation member is made of a conductive material.

5. The development apparatus as claimed in claim 4, wherein said first developer regulation member is provided with a voltage.

6. The development apparatus as claimed in claim 2, wherein said first developer regulation member has a plate-like shape.

7. The development apparatus as claimed in claim 2, wherein said first developer regulation member has a cylindrical shape.

8. The development apparatus as claimed in claim 2, further comprising a second developer regulation member located on an upstream side of the first developer regulation member in the direction of conveying the developer by the developer carrier, the second developer regulation member contacting the developer on the outer surface of the developer carrier so as to regulate a thickness of a layer of the developer on the outer surface of the developer carrier.

9. The development apparatus as claimed in claim 8, wherein said second developer regulation member is made of a nonmagnetic material.

10. The development apparatus as claimed in claim 8, wherein said second developer regulation member is made of a conductive material.

11. The development apparatus as claimed in claim 10, wherein said second developer regulation member is provided with a voltage.

12. The development apparatus as claimed in claim 8, wherein said second developer regulation member has a plate-like shape.

13. The development apparatus as claimed in claim 1, wherein the magnetic field formed by the magnetic field generating means is such that the magnetic brush occupies more than a predetermined part of a space defined by the outer surface of the developer carrier and a closed surface defined by tips of spikes of the magnetic brush.

14. The development apparatus as claimed in claim 13, wherein, when the latent image carrier is removed from the development apparatus, the magnetic field formed by the magnetic field generating means is such that a number of spikes forming the magnetic brush on the outer surface of the developer carrier is 30 pieces/$mm^2$ per unit area in a part to be opposite to the latent image carrier.

15. The development apparatus as claimed in claim 1, wherein an intensity of magnetization of the magnetic carrier forming the magnetic brush is preferably equal to or less than 60 emu/g, and more preferably be equal to or less than 40 emu/g.

16. The development apparatus as claimed in claim 15, wherein an average particle diameter of the magnetic carrier forming the magnetic brush falls within a range from 30 $\mu$m to 100 $\mu$m.

17. The image forming apparatus as claimed in claim 1, wherein the value of said radius of curvature is equal to or smaller than 14 mm.

18. The image forming apparatus as claimed in claim 1, wherein the high development capability is judged based on an occurrence of thinning of a horizontal line in a developed image.

19. The image forming apparatus as claimed in claim 1, wherein the high development capability is judged based on an occurrence of rear end missing in a developed image.

20. An image forming apparatus comprising:

a latent image carrier which carries a latent image to be developed; and a developer apparatus for developing the latent image formed on the latent image carrier using a developer composed of a toner and a magnetic currier particle, comprising:

a hollow developer carrier which carries the developer on an outer surface thereof so as to transfer the developer to the latent image carrier;

a developer application mechanism which applies the developer to the outer surface of said developer carrier;

magnetic field generating means provided inside said developer carrier for generating a magnetic field so that a magnetic brush is formed by the developer on the outer surface of said developer carrier, the magnetic brush being brought into contact with said latent image carrier in a development area where the developer carrier is contiguous to the latent image carrier and an electric field between the latent image carrier and the developer separates the toner from the magnetic carrier of the magnetic brush, wherein the magnetic brush is separated from the latent image carrier outside the development area, and wherein said development area is formed between a round part of said latent image carrier having a radius of curvature and said developer carrier, and the radius of curvature is set to a value at which a high development capability is maintained in the development area.

21. The image forming apparatus as claimed in claim 20, wherein the latent image carrier is a photo-conductor belt.

22. The image forming apparatus as claimed in claim 20, a distance between the latent image carrier and the developer carrier is three to ten times a particle diameter of the magnetic carrier.

23. The image forming apparatus as claimed in claim 20, wherein a ratio of a linear velocity of the developer carrier to a linear velocity of the latent image carrier is preferably smaller than 4, and more preferably close to 1.05.

24. The image forming apparatus as claimed in claim 20, wherein the value of said radius of curvature is equal to or smaller than 14 mm.

25. The image forming apparatus as claimed in claim 20, wherein the high development capability is judged based on an occurrence of thinning of a horizontal line in a developed image.

26. The image forming apparatus as claimed in claim 20, wherein the high development capability is judged based on an occurrence of rear end missing in a developed image.

* * * * *